United States Patent [19]

Bornert

[11] 3,947,235

[45] Mar. 30, 1976

[54] METHOD AND INSTALLATION FOR THE STOVING OF ARTICLES

[75] Inventor: Paul Bornert, La Celle-Saint-Cloud, France

[73] Assignee: Air Industrie, France

[22] Filed: Nov. 14, 1974

[21] Appl. No.: 523,843

[30] Foreign Application Priority Data

Nov. 15, 1973 France ..... 73.40717

[52] U.S. Cl. ..... 432/2; 432/72; 432/144

[51] Int. Cl.[2] ..... F27D 17/00; B08B 15/00

[58] Field of Search ..... 432/2, 72, 144, 145, 245, 432/249

[56] References Cited

UNITED STATES PATENTS 3,472,498 10/1969 Price et al. ..... 432/2

3,590,756 7/1971 Erman ..... 432/72

*Primary Examiner*—John J. Camby

*Attorney, Agent, or Firm*—Larson, Taylor and Hinds

[57] ABSTRACT

The present invention concerns a method and an installation for the stoving of articles, inter alia of freshly painted articles. A combustion is used to eliminate a substantial proportion of the polluting and solvent-charged products given off by the articles during stoving and entrained by the ventilating air which is evacuated from the stove. The purified and heated gas supplied by the combustion of the polluting products is reintroduced into the stove, with fresh air. Before combustion, the ventilation air is preheated in a heat exchanger whose source of heat is supplied with heat by said purified and heated gas.

13 Claims, 1 Drawing Figure

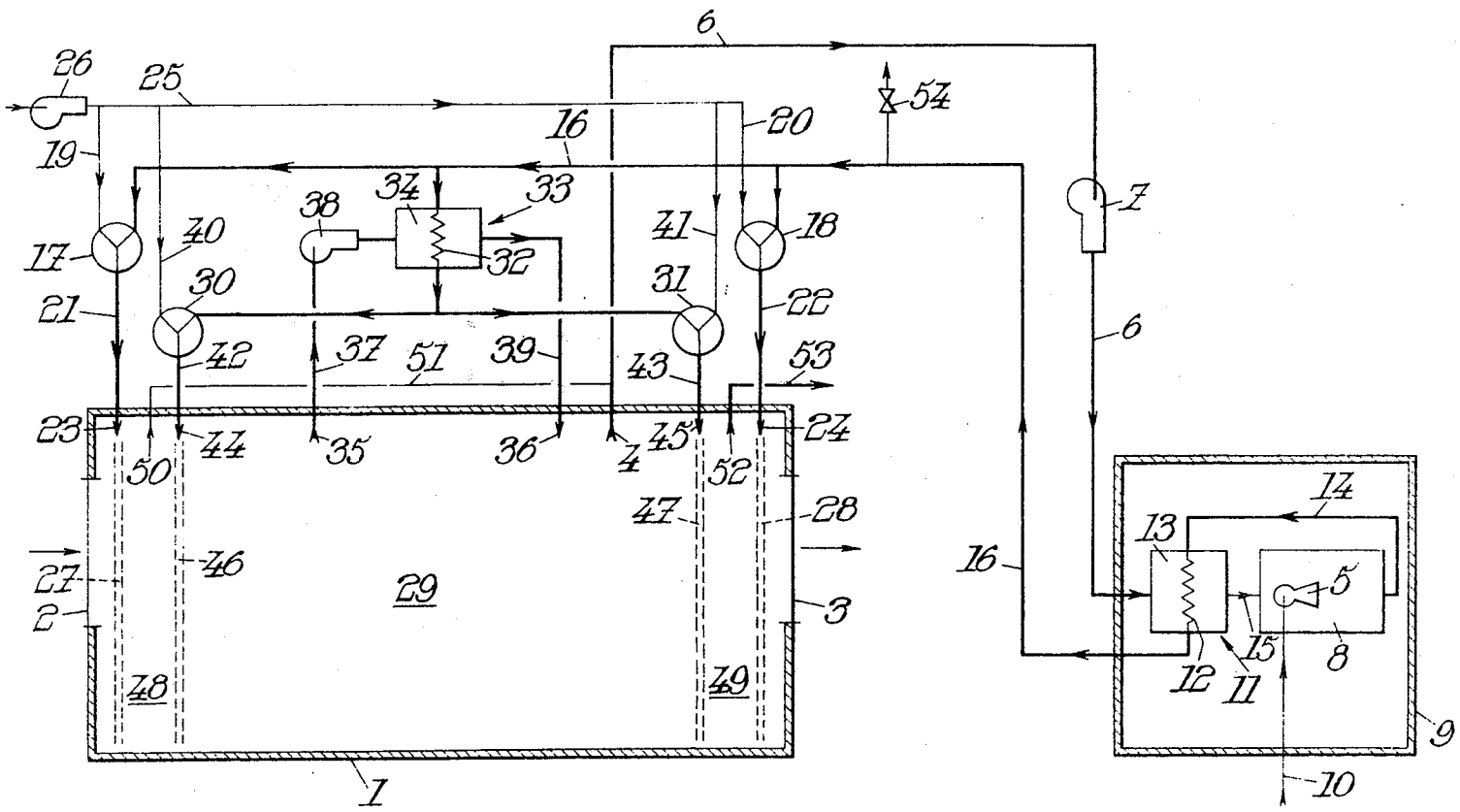
9
14
5
8
10
15
11
12
13
7
6
16
54
18
22
53
24
28
3
20
52
49
41
31
43
45
47
4
6
16
33
32
39
36
34
51
29
1
38
37
35
40
30
42
44
46
25
50
48
26
19
17
21
23
27
2

METHOD AND INSTALLATION FOR THE STOVING OF ARTICLES

BACKGROUND OF THE INVENTION

This invention, due to the work of Paul BORNERT, relates in the first place to a method of stoving articles, inter alia freshly painted articles introduced into a stove and eventually being submitted to other preceding or following treatments in one or more enclosures, and in which combustion is used to eliminate a substantial proportion of the polluting and solvent-charged products given off by the articles during stoving and entrained by the ventilating air which is evacuated from the stove. When articles are stoved, more particularly freshly painted articles, the articles of course give off pulluting solvent-charged products whose carbon content exceeds the content permitted by the Law in many countries. Moreover, these products smell bad. This is why there has been the intention of eliminating by combustion a substantial proportion of the polluting products entrained by the ventilation air which is evacuated from the stove.

For instance, French Patent No. 1 587 679 of Aug. 22, 1968 discloses how to destroy the polluting products by using the ventilation air leaving the stove and containing such products, as the combustion-aiding air of the stove burners and/or by combustion in a heating device of the stove. It is also known to destroy the polluting products in a combustion chamber in which they are burnt, the air thus purified being then ejected to atmosphere; however, in this way considerable amount of heat is lost.

Moreover, the thermal balance sheet of a conventional stove is very poor. For instance, with a stove having a very high weight of production, intended, for instance, for firing the paint on motorcar bodywork, a heat power 20 to 30 times greater than the heat power needed for firing the paint is required. This poor thermal balance sheet is due to losses at the ends of the stove (inlet and discharge of the bodywork), to the storage of heat by the painted bodywork, and more particularly to losses due to ventilation, since the ventilation of stoves, to evacuate the polluting products given off and limit the risk of explosion, is very intense and therefore robs the stoves of a great deal of heat.

SUMMARY OF THE INVENTION

It is an object of the invention to obviate this disadvantage and more particularly to improve the thermal balance sheet of a stove installation.

To this end, in a method of the kind specified according to the invention, the purified and heated air supplied by the combustion of the polluting products is reintroduced into the stove in the form of two gaseous curtains, one adjacent the aperture through which articles enter the stove, the other adjacent the aperture from which the articles are discharged, and if necessary passed into one or more of the said enclosures, mixed with fresh air, and before combustion the ventilation air is preheated in a heat exchanger whose source of heat is supplied with heat by said purified and heated gas.

Thus, according to the invention, the ventilation air reintroduced into the stove after purification and heating by the combustion of the polluting products enables the thermal balance sheet of stoving to be considerably improved and also if necessary improves the thermal balance sheet of the other preceding or following treatments in the other enclosures. Moreover, the preheating of the ventilation air before combustion, in a heat exchanger whose source of heat is supplied with heat by the purified heated gas enables the combustion to be improved, and therefore further improves the thermal performance of stoving.

Moreover, the fact that the purified, heated gas supplied by the combustion of the polluting products is reintroduced into the stove mixed with fresh air allows the convenient and ready adjustment of the temperature of the air supplied to the stove, since if such an arrangement were not to be made, the air reintroduced into the stove, and possibly also carried into one or more of the other preceding or following treatment enclosures, would be too hot to obtain optimum conditions.

The feature that the purified and heated air supplied by the combustion of the polluting products is reintroduced into the stove in the form of two gaseous curtains considerably limits heat losses at the inlet and outlet of the stove, the hot gaseous curtains forming excellent thermal barriers.

In one particularly advantageous embodiment of the method according to the invention, the purified and heated gas supplied by the combustion of the polluting products is to be reintroduced into the stove in the form of two other gaseous curtains each disposed adjacent one of the aforementioned curtains. As a result of this arrangement, adjacent the inlet and oulet apertures of the stove inlet and outlet air locks are created which contribute in a particularly marked manner to further limiting the losses.

Preferably, the two gaseous curtains closest to the central zone of the stove are at a higher temperature than that of the two curtains furthest away therefrom.

Also preferably, a proportion of the ventilating air entraining the polluting, solvent-charged products is evacuated from the stove by being removed between the two gaseous curtains disposed adjacent the aperture through which the articles enter the stove. The fact is that the articles are liable to give off the largest amount of polluting products at the inlet to the stove when the paint solvents are light solvents.

In that case, according to another possible feature of the invention, another proportion of the ventilating air is evacuated from the stove to atmosphere, being removed between the two gaseous curtains which are disposed adjacent the aperture through which the articles are discharged from the stove, because at that place the air is much less polluted and can be evacuated directly to atmosphere without needing to be purified.

In contrast, according to another possible feature of the invention, a proportion of the ventilating air is evacuated from the stove after it has been taken from between the two gaseous curtains which are disposed adjacent the aperture through which the articles are discharged from the stove, more particularly in cases in which the paint solvents are heavy solvents which take longer to evaporate.

In that case, another proportion of the ventilating air is evacuated from the stove to atmosphere, being taken between the two gaseous curtains disposed adjacent the aperture through which the articles enter the stove.

These different possibilities can also be combined with one another.

The invention also relates to a stoving installation for the performance of the method defined hereinbefore, of the kind comprising a stove having an aperture through which the articles to be stoved enter, and an aperture through which the articles are discharged, and at least one evacuating aperture for the ventilating air entraining a substantial proportion of the polluting, solvent-charged products given off by the articles during stoving, a burner connected via an evacuation conduit to the evacuating aperture, and if necessary one or more other enclosures for the preceding or following treatment of the articles, characterised in that the installation comprises a first heat exchanger whose source of heat, supplied with heat by the purified combustion gas coming from the burner, is disposed on the path of the ventilation air coming from the evacuation aperture and is connected via a return conduit to at least one inlet of purified air into the stove and if necessary into one or more of said other enclosures, and connected to the return conduit are two air mixers supplied with fresh air, whose outlet paths are connected respectively to two inlets of purified air into the stove disposed one adjacent the aperture through which the articles enter, and the other adjacent the aperture through which they are discharged, so as to form two hot gaseous curtains.

Also preferably, the installation is characterised in that the return conduit communicates with two other air mixers supplied with fresh air whose outlet paths are connected respectively to two other inlets of purified air into the stove, each disposed adjacent one of the aforesaid inlets so as to form two other hot gaseous curtains.

According to another possible feature, an installation according to the invention is characterised in that an evacuating aperture for the ventilation air is disposed between the two purified air inlets which are disposed adjacent the aperture through which the articles enter the stove, or adjacent the aperture through which the articles are discharged from the stove.

According to another possible feature of the invention, another evacuating aperture for the ventilation air in communication with the atmosphere is disposed between the two purified air inlets which are disposed adjacent the aperture through which the articles are discharged from the stove, or adjacent the aperture through which the articles enter the stove.

Also advantageously, the return conduit communicates with the two other air mixers via the heat source of a second heat exchanger which is disposed on the path of a portion of the ventilation air taken from a central zone of the stove and reintroduced into said zone. This arrangement further encourages the rise in temperature of the stove when it is put into operation and ensures satisfactory homogenization of the temperatures.

The arrangement also enables the amount of fresh air fed to the two other air mixers to be reduced, since heat is taken from the return conduit by the second heat exchanger, such heat being recovered to heat the said central zone.

SHORT DESCRIPTION OF THE DRAWING

One embodiment of the invention is shown by way of nonlimitative example in the single accompanying drawing, which illustrates diagrammatically a motor-car bodywork stoving installation according to the invention.

DESCRIPTION OF PREFERRED EMBODIMENTS

The stoving installation illustrated in the drawing comprises a stove 1 having an inlet aperture 2 through which freshly painted motor-car bodywork to be stoved (not shown) is introduced and an output aperture 3 through which the bodywork is evacuated from the stove after being dried. The installation also comprises a first evacuation aperture 4 for the ventilation air which entrains a substantial proportion of the polluting solvent-charged products which are given off by the bodywork while the paint dries. A burner 5 is connected to the aperture 4 via an evacuation conduit 6 connected to a first fan 7 so as to produce a current of ventilating air in the conduit 6 in the direction indicated by the arrows. The burner 5 is disposed in a combustion chamber 8 disposed in a combustion enclosure or incinerator 9. The burner 5 is supplied with fuel via a conduit 10.

Enclosure 9 also contains a first heat exchanger 11 whose source of heat 12, disposed in an exchange chamber 13, is supplied with heat by the purified heated combustion gas coming from the combustion chamber 8; to this end a conduit 14 connects the chamber 8 to the source of heat 12. The latter is also disposed on the path of the ventilation air coming from the evacuating conduit 6 and passing into the combustion chamber 8 via conduit 15 after passing through the exchange chamber 13. The ventilation air is thus preheated before acting as a combustion-aiding fuel in the combustion chamber 8.

Lastly, the heat source 12 is connected via return conduit 16, for purified and heated combustion gas, to two three-way air mixers 17, 18 which are supplied with fresh air via conduits 19, 20 and whose outlet parts 21, 22 are connected to two inlets 23, 24 for purified air to the stove 1. The conduits 19, 20 are connected to a common conduit 25 which supplies fresh air and communicates with the delivery of the second fan 26 whose intake is from atmosphere. The inlet 23 is disposed adjacent the inlet aperture 2 of the stove so as to form a hot gaseous curtain 27, and the inlet 24 is disposed adjacent the outlet aperture 3 of the stove, so as to form a hot gaseous curtain 28; the two gaseous curtains thus form effective thermal barriers between the outside and the central zone 29 of the stove.

The return conduit 16 also communicates with two other three-way air mixers 30, 31 via the heat source 32 of a second heat exchanger 33 whose exchange chamber 34 is traversed by a portion of the ventilation air taken in the central zone 29 of the stove by a second evacuating aperture 35, such part of the ventilation air returning to such central zone via another inlet 36. The evacuating aperture 35 communicates with the exchange chamber 34 via an upstream conduit 37 and a third fan 38, the other inlet 36 communicating via a downstream conduit 39. The mixers 30, 31 are supplied with fresh air via conduits 40, 41 connected to conduit 25 and their outlet parts 42, 43 are connected to two other inlets 44, 45 for purified air into the stove 1.

The inlet 44 is disposed adjacent the inlet 23 so as to form another hot gaseous curtain 46, and the inlet 45 is disposed adjacent the inlet 24 so as to form another hot gaseous curtain 47, the curtains 46, 47 being closer to the central zone 29 than the curtains 27, 28. The four aforementioned air exchangers are also so adjusted that the temperature of the curtains 46, 47 is higher than that of the curtains 27, 28. However, the temperature of the four gaseous curtains is close to that inside the stove 1. Between the curtains 27 and 46 there is therefore formed an inlet air look 48 for motor-car bodywork, an outlet air lock 49 being formed between the curtains 47 and 28.

Moreover, a second evacuating aperture for the ventilation air 50 is disposed between the two purified air inlets 23 and 24 and connected to the evacuation conduit 6 via a conduit 51, a third evacuating aperture for the ventilation air 52 being disposed between the two air inlets 45 and 24 and connected directly to atmosphere via conduit 53. Lastly, to eliminate any excess heat if necessary, a valve 54 communicating with atmosphere is connected to the return conduit 60.

When the installation is started up, the fans 7, 26, 38 are started. The burner 5 is fed with fuel via conduit 10. The combustion-aiding air is supplied to the combustion chamber 8 via the ventilation air evacuating conduit 6, the fan 7, and then the conduit 15, after passing through the exchange chamber 13, in which it is preheated by the heat source 12. The heated air of combustion returns to the stove 1 via conduit 16, directly across mixers 17, 18 and indirectly across mixers 30, 31, after passing through the heat source 32 of the heat exchanger 33. In the manner described hereinbefore, therefore, hot gaseous curtains 27, 46; 47, 28 and inlet and outlet air locks, 48, 49 respectively, are therefore formed in the stove 1. The air of the stove taken at 35 is also heated by the heat source 32 when it passes through the exchange chamber 34, being reintroduced into the central zone 29 at a place 36. The air in the conduit 16 therefore gives up heat to the air taken at 35. When the air in the stove has reached the desired temperature, the freshly painted bodywork to be dried is introduced via the aperture 2 and, after passing a predetermined period in the stove, is evacuated via the outlet aperture 3. Polluting products are therefore given off in the stove which are charged with solvents and evacuated via aperture 4 and 50. The products are entrained by the ventilation air into the evacuation conduit 6 and burnt in the combustion chamber 8, in which the temperature rises. The purified air is reintroduced into the stove via the conduit 16 after preheating the polluted air entering the exchange chamber 13. The four mixers are adjusted, for instance automatically, to determine the amount of fresh air supplied to the stove, so that the bodywork is not subjected to an excessive temperature. It should be noted that the mixers 30, 31 consume a relatively small amount of fresh air, since in them such air is mixed with the hot air already cooled by heat being removed on the heat source 32. Air is also evacuated from the stove 1 via the aperture 52 and is ejected directly to atmosphere, being much less polluted than the air taken at 50 or 4.

Lastly, to enable the installation according to the invention to be satisfactorily adjusted, inter alia if the heat produced by the combustion chamber 8 is greater than the heat needed by the stove, the valve 54 enables the conduit 16 to be vented to atmosphere, thus eliminating excess heat. The hot air thus ejected is of course purified, since it is ejected to atmosphere only after passing through chamber 8.

Finally, it can be noted that the invention affords considerable advantages over the prior art, since essentially on the one hand it enables only gases to be ejected to atmosphere which are slightly polluted, their content of harmful agents being at any rate lower than that required by the law, and it also enables the thermal performance of the stove to be very considerably improved.

Since, moreover, a large amount of heat is given off in the chamber 8, instead of ejecting the excess heat to atmosphere it might be used for the main or supplementary heating of other treatment enclosures upstream or downstream of the stove, if necessary also mixed with fresh air.

Clearly, and as results from the foregoing, the invention is not limited to those methods of application and embodiments which have been more specially considered but, on the contrary, the invention covers all variants.

We claim:

1. A method of stoving articles, such as freshly painted articles, which enter a stove and may undergo other preceeding or subsequent treatment in one or more enclosures, and in which combustion is used to eliminate a substantial proportion of the polluting and solvent-charged products given off by the articles during stoving and entrained by the ventilating air which is evacuated from the stove, said stoving being carried out in a stove including an inlet aperture through which the articles enter the stove and an outlet aperture from which the articles are discharged from the stove, said method comprising reintroducing the purified and heated air supplied by the combustion of the polluting products into the stove in the form of two gaseous curtains, one adjacent the inlet aperture and the other adjacent the outlet aperture, mixing said purified and heated air with fresh air prior to reintroduction into the stove, preheating the ventilating air in a heat exchanger prior to combustion, and supplying heat to said heat exchanger from said purified and heated gas.

2. A method as set forth in claim 1, wherein the purified and heated gas supplied by the combustion of the polluting products is to be reintroduced into the stove in the form of two other gaseous curtains each disposed adjacent one of the aforementioned curtains.

3. A method as set forth in claim 2, wherein the two gaseous curtains closest to the central zone of the stove are at a higher temperature than that of the two curtains furthest away therefrom.

4. A method as set forth in claim 2, wherein a proportion of the ventilating air entraining the polluting, solvent-charged products is evacuated from the stove by being removed between the two gaseous curtains disposed adjacent the aperture through which the articles enter the stove.

5. A method as set forth in claim 3, wherein in that another proportion of the ventilating air is evacuated from the stove to atmosphere, this proportion being removed between the two gaseous curtains which are disposed adjacent the aperture through which the articles are discharged from the stove.

6. A method as set forth in claim 2 characterised in that a proportion of the ventilation air is evacuated from the stove by this proportion being taken between the two gaseous curtains disposed adjacent the aperture through which the articles are discharged from the stove.

7. A method as set forth in any of claims 2, characterised in that a proportion of the ventilation air is evacuated from the stove to atmosphere, being taken between the two gaseous curtains disposed adjacent the aperture through which the objects enter the stove.

8. A stoving installation for stoving articles, such as painted articles, comprising a stove having an aperture through which the articles to be stoved enter, an aperture through which the articles are discharged, and at least one evacuating aperture for the ventilating air which entrains a substantial portion of the polluting, solvent-charged products given off by the articles during stoving, and a burner connected through an evacuation conduit to the evacuating aperture for combusting said ventilating air and said products entrained therein and producing purified combustion gas, said installation comprising a first heat exchanger including a heat source disposed in the path of the ventilating air coming from said evacuation aperture and connected to a return conduit, means for supplying heat from said purified combustion gas coming from said burner to said heat source of said first heat exchanger, first and second air mixers connected to said return conduit and supplied with fresh air, the outlet paths of said air mixers being connected respectively to first and second purified air inlets for said stove so as to form first and second hot gaseous curtains, said first inlet being disposed adjacent the aperture through which the articles enter and said second inlet being disposed adjacent the aperture through which the articles are discharged.

9. An installation as claimed in claim 8, further comprising third and fourth air mixers supplied with fresh air and connected to communicate with said return conduit, means for connecting the outlets of said third and fourth air mixers with third and fourth purified air inlets for said stove, said third and fourth inlets being respectively disposed adjacent one of said first and second inlets so as to form two further hot gaseous curtains.

10. An installation as claimed in claim 9, further comprising a further conduit for ventilation air taken from a central zone of the stove and reintroduced into said central zone of the stove, a second heat exchanger including a heat source disposed in said further conduit, means connecting said return conduit to said heat source of said second heat exchanger, and means for connecting the output of said heat source of said second heat exchanger to said third and fourth air mixers.

11. An installation as set forth in claim 9, further comprising an evacuating outlet for the ventilation air disposed between the two purified air inlets which are disposed adjacent the aperture through which the articles enter the stove.

12. An installation as set forth in claim 11, further comprising another evacuating outlet for the ventilation air communicating with atmosphere disposed between the two purified air inlets which are disposed adjacent the aperture through which the articles are discharged from the stove.

13. An installation as set forth in claim 9, further comprising an evacuating outlet for the ventilation air disposed between the two purified air inlets which are disposed adjacent the aperture through which the articles are discharged from the stove.

* * * * *